US009620269B2

(12) United States Patent
Sun

(10) Patent No.: US 9,620,269 B2
(45) Date of Patent: Apr. 11, 2017

(54) METHOD AND EQUIPMENT FOR PROCESSING NDFEB RARE EARTH PERMANENT MAGNETIC ALLOY WITH HYDROGEN PULVERIZATION

(71) Applicant: SHENYANG GENERAL MAGNETIC CO., LTD., Shenyang, Liaoning (CN)

(72) Inventor: Baoyu Sun, Liaoning (CN)

(73) Assignee: SHENYANG GENERAL MAGNETIC CO., LTD, Shenyang, Liaoning (CN)

( * ) Notice: Subject to any disclaimer, the term of this patent is extended or adjusted under 35 U.S.C. 154(b) by 65 days.

(21) Appl. No.: 14/708,460

(22) Filed: May 11, 2015

(65) Prior Publication Data

US 2015/0243417 A1 Aug. 27, 2015

(30) Foreign Application Priority Data

May 11, 2014 (CN) ..... 2014 1 0194941

(51) Int. Cl.
*H01F 41/02* (2006.01)
*B22F 5/00* (2006.01)
(Continued)

(52) U.S. Cl.
CPC ..... *H01F 1/0577* (2013.01); *B22F 9/023* (2013.01); *C21D 3/06* (2013.01); *C22C 38/002* (2013.01);
(Continued)

(58) Field of Classification Search
None
See application file for complete search history.

(56) References Cited

U.S. PATENT DOCUMENTS 6,461,565 B2 10/2002 Tokuhara et al.
6,491,765 B2 12/2002 Okayama et al.
(Continued)

FOREIGN PATENT DOCUMENTS

CN 1076115 12/2001
CN 1191903 3/2005
(Continued)

OTHER PUBLICATIONS

Machine translation of JP06-108104 A, Apr. 1994.*

*Primary Examiner* — Jie Yang
*Assistant Examiner* — Xiaowei Su

(57) ABSTRACT

A method and an equipment for processing NdFeB rare earth permanent magnetic alloy with a hydrogen pulverization are provided. The method includes steps of: providing a continuous hydrogen pulverization equipment; while driving by a transmission device, passing a charging box loaded with rare earth permanent magnetic alloy flakes orderly through a hydrogen absorption chamber, having a temperature of 50-350° C. for absorbing hydrogen, a heating and dehydrogenating chamber, having a temperature of 600-900° C. for dehydrogenating, and a cooling chamber of the continuous hydrogen pulverization equipment; receiving the charging box by a discharging chamber through a discharging valve; pouring out the alloy flakes after the hydrogen pulverization into a storage tank at a lower part of the discharging chamber; sealing up the storage tank under a protection of nitrogen; and, moving the charging box out through a discharging door of the discharging chamber and re-loading, for repeating the previous steps.

13 Claims, 3 Drawing Sheets

(51) Int. Cl.

| | |
|---|---|
| ***H01F 1/057*** | (2006.01) |
| ***B22F 9/02*** | (2006.01) |
| ***C21D 3/06*** | (2006.01) |
| ***C22C 38/00*** | (2006.01) |
| ***C22C 38/10*** | (2006.01) |
| ***C22C 38/16*** | (2006.01) |
| ***C22C 38/32*** | (2006.01) |

(52) U.S. Cl.

CPC ..... *C22C 38/005* (2013.01); *C22C 38/10* (2013.01); *C22C 38/16* (2013.01); *C22C 38/32* (2013.01); *H01F 1/0573* (2013.01); *H01F 41/0273* (2013.01); *B22F 2998/10* (2013.01); *B22F 2999/00* (2013.01)

(56) References Cited

U.S. PATENT DOCUMENTS

| | | | | |
|---|---|---|---|---|
| 6,527,874 | B2 | 3/2003 | Li | |
| 6,537,385 | B2 | 3/2003 | Okayama et al. | |
| 2013/0309122 | A1 * | 11/2013 | Mochizuki ..... | C22C 38/002 419/33 |

FOREIGN PATENT DOCUMENTS

| | | | |
|---|---|---|---|
| JP | 63065742 | | 12/1988 |
| JP | 06108104 | A * | 4/1994 |
| JP | 08005664 | | 1/1996 |

* cited by examiner

METHOD AND EQUIPMENT FOR PROCESSING NDFEB RARE EARTH PERMANENT MAGNETIC ALLOY WITH HYDROGEN PULVERIZATION

CROSS REFERENCE OF RELATED APPLICATION

This invention claims priority under 35 U.S.C. 119(a-d) to CN 201410194941.3, filed May 11, 2014.

BACKGROUND OF THE PRESENT INVENTION

Field of Invention

The present invention relates to permanent magnetic devices, and more particularly to a method and an equipment for hydrogen-pulverizing NdFeB rare earth permanent magnetic alloy.

Description of Related Arts

The NdFeB rare earth permanent magnetic material is increasingly applied because of excellent magnetism, and widely applied in fields of medical nuclear magnetic resonance imaging, computer hard disk drives, audio equipments and mobile phones. Along with requirements of an energy-saving and low-carbon economy, the NdFeB rare earth permanent magnetic material is further applied in fields of auto parts, household appliances, energy-saving control electric motors, hybrid power vehicles and wind power generation.

In 1982, Japan Sumitomo Special Metals Co., Ltd. initially disclosed Japanese patent applications, JP 1,622,492 and JP 2,137,496, of the NdFeB rare earth permanent magnetic material and then submitted United States patent applications and European patent applications, wherein features, constituents and a preparation method of the NdFeB rare earth permanent magnetic material were disclosed; a $Nd_2Fe_{14}B$ phase was confirmed as a main phase; and a rich Nd phase, a rich B phase and rare earth oxide impurities were confirmed as a grain boundary phase.

On Apr. 1, 2007, Japan Hitachi Metals Co., Ltd. merged with the Japan Sumitomo Special Metals Co., Ltd. and inherited rights and obligations of the patents of NdFeB rare earth permanent magnets of the Japan Sumitomo Special Metals Co., Ltd. On Aug. 17, 2012, the Japan Hitachi Metals Co., Ltd filed a lawsuit in United States International Trade Commission (ITC) for owning patents of U.S. Pat. No. 6,461,565, U.S. Pat. No. 6,491,765, U.S. Pat. No. 6,537,385 and U.S. Pat. No. 6,527,874 which were applied in United States.

The Chinese patent application publication, ZL93115008.6, disclosed a preparation method of a high-performance R—Fe—B permanent magnetic material, comprising steps of: smelting by a strip billet continuous casting method to obtain alloy flakes, having a main phase of a $R_2Fe_{14}B$ phase, a thickness of 0.03-10 mm and a length less than 50 mm; loading the alloy flakes into a container for absorbing hydrogen at a pressure between 200 Torr and 50 $Kg/cm^2$; after absorbing the hydrogen, heating at a temperature of 100-750° C. for more than 0.5 hour for dehydrogenating; powdering the alloy flakes into fine powder, having particles of an averaged size of 1-10 μm, within a inert gas jet mill; loading the fine powder into a mold and instantaneously exerting a pulse magnetic field higher than 10 KOe for an alignment; then mold-pressing, sintering and aging.

The Chinese patent publication, CN1191903C, disclosed a device for hydrogenating rare earth alloy and a method thereof, wherein the device comprises a housing, a gas inlet, a gas outlet, an airflow generating device and a wind shield. The device belongs to a single chamber hydrogen pulverization device with a low production and a high energy cost.

SUMMARY OF THE PRESENT INVENTION

An object of the present invention is to provide a method for preparing a NdFeB rare earth permanent magnet and an equipment thereof which improve magnetism and reduce costs.

With an expansion in application markets of a NdFeB rare earth permanent magnetic material, a shortage of rare earth resources is increasingly severe, especially in fields of electronic components, energy-saving control electric motors, auto parts, new energy vehicles and wind power generation which need relatively more heavy rare earth to improve a coercive force. Thus, reducing a usage of rare earth, especially a usage of the heavy rare earth, is an important issue to be solved. Through explorations, the present invention provides a preparation method of a high-performance NdFeB rare earth permanent magnetic device.

Accordingly, in order to accomplish the above objects, the present invention adopts following technical solutions.

A method for processing NdFeB rare earth permanent magnetic alloy with a hydrogen pulverization comprises steps of: providing a continuous hydrogen pulverization equipment for processing rare earth permanent magnetic alloy with the hydrogen pulverization; loading rare earth permanent magnetic alloy flakes into a charging box; passing the charging box which is driven by a transmission device orderly through a hydrogen absorption chamber, a heating and dehydrogenating chamber and a cooling chamber of the continuous hydrogen pulverization equipment; receiving the charging box by a discharging chamber through a discharging valve; pouring out the alloy flakes after the hydrogen pulverization into a storage tank at a lower part of the discharging chamber; sealing up the storage tank under a protection of nitrogen; and moving the charging box out through a discharging door of the discharging chamber and re-loading the charging box for repeating the previous steps; wherein the hydrogen absorption chamber has a temperature controlled at between 50° C. and 350° C. for absorbing hydrogen; the continuous hydrogen pulverization equipment comprises at least one heating and dehydrogenating chamber, having a temperature controlled at between 600° C. and 900° C. for dehydrogenating, and at least one cooling chamber.

In some embodiments, the continuous hydrogen pulverization equipment comprises two heating and dehydrogenating chambers, wherein the charging box stays in the two heating and dehydrogenating chambers successively while staying in the respective heating and dehydrogenating chamber for between 2 hours and 6 hours; and the continuous hydrogen pulverization equipment comprises two cooling chambers, wherein the charging box stays in the two cooling chambers successively while staying in the respective cooling chamber for between 2 hours and 6 hours.

In some embodiments, the continuous hydrogen pulverization equipment comprises three heating and dehydrogenating chambers, wherein the charging box stays in the three heating and dehydrogenating chambers successively while staying in the respective heating and dehydrogenating chamber for between 1 hour and 4 hours; and the continuous hydrogen pulverization equipment comprises three cooling chambers, wherein the charging box stays in the three cooling chambers successively while staying in the respective cooling chamber for between 1 hour and 4 hours.

A heater is provided in the hydrogen absorption chamber and the hydrogen absorption chamber has a temperature controlled at between 80° C. and 300° C. for heating.

A quantitative hydrogen filling device is provided in the heating and dehydrogenating chamber, wherein a certain amount of the hydrogen is filled in before the dehydrogenating is over.

A continuous hydrogen pulverization equipment for NdFeB rare earth permanent magnetic alloy comprises a transmission device, a charging box, a feeding valve, a hydrogen absorption chamber, a hydrogen absorption valve, a heating and dehydrogenating chamber, chamber isolating valves, a cooling chamber, a discharging valve, a discharging chamber, a discharging door of the discharging chamber, a storage tank, a hydrogen filling system, a quantitative hydrogen filling device and an evacuating device, wherein: the feeding valve, the hydrogen absorption chamber, the hydrogen absorption valve, the heating and dehydrogenating chamber, the chamber isolating valves, the cooling chamber, the discharging valve, the discharging chamber and the discharging door of the discharging chamber are successively connected; the storage tank is connected with a lower part of the discharging chamber; the transmission device is provided at an upper part of the hydrogen absorption chamber, the heating and dehydrogenating chamber, the cooling chamber and the discharging chamber; the charging box hanging on the transmission device, through a guide rail of the transmission device, successively enters the hydrogen absorption chamber, the heating and dehydrogenating chamber, the cooling chamber and the discharging chamber; the alloy flakes in the charging box are poured into the storage tank within the discharging chamber; then the charging box moves out through the discharging door of the discharging chamber and, after re-loading, enters the hydrogen absorption chamber again for repeating the previous steps; and the continuous hydrogen pulverization equipment comprises at least one heating and dehydrogenating chamber and at least one cooling chamber.

In some embodiments, the continuous hydrogen pulverization equipment comprises two heating and dehydrogenating chambers and two cooling chambers, wherein the chamber isolating valves are provided between each two neighboring chambers.

In some embodiments, the continuous hydrogen absorption equipment comprises three heating and dehydrogenating chambers and three cooling chambers, wherein the chamber isolating valves are provided between each two neighboring chambers.

A heater is provided in the hydrogen absorption chamber and the hydrogen absorption chamber has a temperature controlled at between 50° C. and 400° C. for heating.

The quantitative hydrogen filling device is provided in the last heat and dehydrogenating chamber.

The hydrogen absorption chamber has a highest temperature of 400° C. and the heating and dehydrogenating chamber has a highest temperature of 950° C.

A method for preparing a NdFeB rare earth permanent magnet, comprises steps of:

smelting alloy into alloy flakes;

processing the alloy flakes with a hydrogen pulverization by a continuous hydrogen pulverization equipment, further comprising steps of: loading the alloy flakes into a charging box; passing the charging box which is driven by a transmission device orderly through a feeding valve, a hydrogen absorption chamber, a hydrogen absorption valve, a heating and dehydrogenating chamber, chamber isolating valves and a cooling chamber of the continuous hydrogen pulverization equipment; receiving the charging box by a discharging chamber through a discharging valve; pouring out the alloy flakes after the hydrogen pulverization into a storage tank at a lower part of the discharging chamber; sealing up the storage tank under a protection of nitrogen; and, moving the charging box out through a discharging door of the discharging chamber and re-loading the charging box for repeating the previous steps;

sending the storage tank into a first mixing device for pre-mixing;

after the pre-mixing, powdering the alloy flakes into alloy powder by a jet mill under the protection of the nitrogen;

then obtaining a rare earth permanent magnet via compacting in a magnetic field and sintering; and finally processing the rare earth permanent magnet into a rare earth permanent magnetic device with machining and a surface treatment.

The step of smelting the alloy into the alloy flakes comprises steps of: heating R—Fe—B-M raw materials up over 500° C. in vacuum; filling in argon, and continuing heating to melt and refine the R—Fe—B-M raw materials into a smelt alloy liquid, wherein $T_2O_3$ micro powder is added into the R—Fe—B-M raw materials; thereafter, casting the smelt alloy liquid into a rotating roller with water quenching through an intermediate tundish, and obtaining the alloy flakes; wherein:

R comprises at least one rare earth element, Nd;

M is at least one member selected from a group consisting of Al, Co, Nb, Ga, Zr, Cu, V, Ti, Cr, Ni and Hf;

$T_2O_3$ is at least one member selected from a group consisting of $Dy_2O_3$, $Tb_2O_3$, $Ho_2O_3$, $Y_2O_3$, $Al_2O_3$ and $Ti_2O_3$; and an amount of the $T_2O_3$ micro powder is: $0 \leq T_2O_3 \leq 2\%$.

Preferably, the amount of the $T_2O_3$ micro powder is: $0 < T_2O_3 \leq 0.8\%$;

preferably, the $T_2O_3$ micro powder is at least one of $Al_2O_3$ and $Dy_2O_3$;

further preferably, the $T_2O_3$ micro powder is $Al_2O_3$; and further preferably, the $T_2O_3$ micro powder is $Dy_2O_3$.

In some embodiments, the step of smelting the alloy into the alloy flakes comprises steps of: heating R—Fe—B-M raw materials and $T_2O_3$ micro powder up over 500° C. in vacuum; filling in argon, and continuing heating to melt the R—Fe—B-M raw materials into a smelt alloy liquid; refining and then casting the smelt alloy liquid into a rotating roller with water quenching through an intermediate tundish; and obtaining the alloy flakes from the smelt alloy liquid after quenching the rotating roller.

In some embodiments, the step of smelting the alloy into the alloy flakes comprises steps of: heating R—Fe—B-M raw materials up over 500° C. in vacuum; filling in argon, and continuing heating to melt the R—Fe—B-M raw materials into a smelt alloy liquid; refining and then casting the smelt alloy liquid into a rotating roller with water quenching through an intermediate tundish; and obtaining the alloy flakes from the smelt alloy liquid after quenching the rotating roller.

In some embodiments, before the step of sending the storage tank into the first mixing device for the pre-mixing, the method for preparing the NdFeB rare earth permanent magnet further comprises a step of: adding a lubricant or an antioxidant into the storage tank.

In some embodiments, before the step of sending the storage tank into the first mixing device for the pre-mixing, the method for preparing the NdFeB rare earth permanent magnet further comprises a step of: adding $T_2O_3$ micro powder into the storage tank.

In some embodiments, before the step of powdering the alloy flakes into the alloy powder by the jet mill under the protection of the nitrogen, the method for preparing the NdFeB rare earth permanent magnet further comprises steps of: adding the alloy flakes after the hydrogen pulverization into the first mixing device for pre-mixing; and adding at least one of an antioxidant and a lubricant during the pre-mixing.

In some embodiments, before the step of powdering the alloy flakes into the alloy powder by the jet mill under the protection of the nitrogen, the method for preparing the NdFeB rare earth permanent magnet further comprises steps of: adding the alloy flakes after the hydrogen pulverization into the first mixing device for pre-mixing; and adding at least one of oxide micro powder during the pre-mixing.

The step of powdering the alloy flakes into the alloy powder by the jet mill under the protection of the nitrogen further comprises steps of: adding the mixed powder after the hydrogen pulverization into a hopper of a feeder; sending the mixed powder into a grinder by the feeder; grinding via a high-speed gas flow which is ejected by a nozzle; sending the ground powder into a centrifugal sorting wheel along with the gas flow to select the ground powder; sending rough powder beyond a required particle size back to the grinder under a centrifugal force to continue grinding, and sending fine powder below the required particle size which are selected out by the centrifugal sorting wheel into a cyclone collector for collecting; receiving and collecting, by a post cyclone collector, the fine powder which are discharged out along with the gas flow from a gas discharging pipe of the cyclone collector; compressing, by a compressor, and cooling, by a cooler, gas which is discharged out by the post cyclone collector; and sending the compressed and cooled gas into an inlet pipe of the nozzle for recycling the nitrogen.

The fine powder which is collected by the cyclone collector, through a first valve which opens and closes alternately, is collected by a powder mixer which is provided at a lower part of the cyclone collector; the fine powder which is collected by the post cyclone collector, through a second valve which opens and closes alternately, is collected by the powder mixer; and the fine powder is mixed by the powder mixer and then sent into a depositing tank.

The fine powder which is collected by the cyclone collector and the fine powder which is collected by the post cyclone collector are introduced into the depositing tank by a depositing device.

In some embodiments, the fine powder is collected by 2-6 post cyclone collectors which are parallel connected.

In some embodiments, the fine powder is collected by 4 post cyclone collectors which are parallel connected.

In some embodiments, after the step of powdering the alloy flakes into the alloy powder by the jet mill, the alloy powder is sent to a second mixing device for post-mixing and powder, having an averaged particle size of 1.6-2.9 μm after the post-mixing, is obtained.

In some embodiments, after the step of powdering the alloy flakes into the alloy powder by the jet mill, the alloy powder is sent to the second mixing device for post-mixing and powder, having an averaged particle size of 2.1-2.8 μm after the post-mixing, is obtained.

The step of compacting in the magnetic field further comprises steps of: loading the NdFeB rare earth permanent magnetic alloy powder into a sealed magnetic field compressor under a protection of nitrogen; under the protection of the nitrogen, within the sealed magnetic field compressor, sending weighed load into a mold chamber of a mold after assembling; then providing a seaming chuck into the mold chamber; sending the mold into an alignment space of an electromagnet, wherein the alloy powder within the mold are processed with pressure adding and pressure holding, within an alignment magnetic field region; obtaining a magnet block; demagnetizing the magnet block, and thereafter, resetting a hydraulic cylinder; sending the mold back to a powder loading position; opening the mold to retrieve the magnet block which is packaged with plastic or a rubber cover; then reassembling the mold and repeating the previous steps; sending the packaged magnet blocks into a load plate for a batch output, and then extracting the packaged magnet blocks out of the sealed magnetic field compressor; and then, sending the extracted magnet blocks into an isostatic pressing device for isostatic pressing.

The step of compacting in the magnetic field comprises semi-automatically compacting in the magnetic field and automatically compacting in the magnetic field.

The step of semi-automatically compacting in the magnetic field comprises steps of: inter-communicating a load tank filled with the NdFeB rare earth permanent magnetic alloy powder with a feeding inlet of an alignment magnetic field semi-automatic compressor under the protection of the nitrogen; thereafter, discharging air between the load tank and a valve of the feeding inlet of the semi-automatic compressor; then opening the valve of the feeding inlet to introduce the powder within the load tank into a hopper of a weighing batcher; after weighing, automatically sending the powder into a mold chamber of a mold by a powder sender; after removing the powder sender, moving an upper pressing tank of the semi-automatic compressor downward into the mold chamber for magnetizing and aligning the powder, wherein the powder is compressed and compacted in a magnetic field and a magnet block is obtained; demagnetizing the magnet block, and then ejecting the magnet block out of the mold chamber; sending the magnet block into a load platform within the alignment magnetic field semi-automatic compressor under the protection of the nitrogen; packaging the magnet block with plastic or a rubber cover via gloves; sending the packaged magnet blocks into the load plate for a batch output, and then sending into an isostatic pressing device for isostatic pressing.

The step of isostatic pressing further comprises steps of: sending the packaged magnet blocks into a high-pressure chamber of the isostatic pressing device, wherein an internal space of the high-pressure chamber except the packaged magnet blocks is full of hydraulic oil; sealing and then compressing the hydraulic oil within the high-pressure chamber, wherein the hydraulic oil is compressed with a pressure of 150-300 MPa; decompressing, and then extracting the magnet blocks out.

Preferably, the isostatic pressing device has two high-pressure chambers, wherein a first one is sleeved out of a second one. Thus, the second one is an inner chamber and the first one is an outer chamber. The step of isostatic pressing comprises steps of: sending the packaged magnet blocks into the inner chamber of the isostatic pressing device, wherein an internal space of the inner chamber except the package magnet blocks is full of a liquid medium; and filling the outer chamber of the isostatic pressing device with the hydraulic oil, wherein the outer chamber is inter-communicated with a high pressure generating device; a pressure of the hydraulic oil of the outer chamber is transmitted into the inner chamber via a separator between the inner chamber and the outer chamber. Thus, the pressure within the inner chamber increases accordingly; and the pressure within the inner chamber is 150-300 MPa.

The step of automatically compacting in the magnetic field comprises steps of: inter-communicating a load tank filled with the NdFeB rare earth permanent magnetic alloy powder with a feeding inlet of an alignment magnetic field automatic compressor under the protection of the nitrogen; thereafter, discharging air between the load tank and a valve of the feeding inlet of the automatic compressor; then opening the valve of the feeding inlet to introduce the powder within the load tank into a hopper of a weighing batcher; after weighing, automatically sending the powder into a mold chamber of a mold by a powder sender; after removing the powder sender, moving an upper pressing tank of the automatic compressor downward into the mold chamber for magnetizing and aligning the powder, wherein the powder is compressed and compacted and a magnet block is obtained; demagnetizing the magnet block, and then ejecting the magnet block out of the mold chamber; sending the magnet block into a charging box of the alignment magnetic field automatic compressor under the protection of the nitrogen; when the charging box is full, closing the charging box, and sending the charging box into a load plate; when the load plate is full, opening a discharging valve of the alignment magnetic field automatic compressor under the protection of the nitrogen to transmit the load plate full of the charging boxes into a transmission sealed box under the protection of the nitrogen; and then, under the protection of the nitrogen, intercommunicating the transmission sealed box with a protective feeding box of a vacuum sintering furnace to send the load plate full of the charging boxes into the protective feeding box of the vacuum sintering furnace.

The sealed magnetic field compressor under the protection of the nitrogen has electromagnetic pole columns and magnetic field coils which are respectively provided with a cooling medium. The cooling medium is water, oil or refrigerant; and during compacting, the electromagnetic pole columns and the magnetic field coils form a space for containing the mold at a temperature lower than 25° C.

Preferably, the cooling medium is water, oil or refrigerant; and during the compacting, the electromagnetic pole columns and the magnetic field coils form a space for containing the mold at a temperature lower than 5° C. and higher than −10° C.; and the powder is compressed and compacted at a pressure of 100-300 MPa.

The step of sintering further comprises steps of: under the protection of the nitrogen, sending a magnet block into a continuous vacuum sintering furnace for sintering; while driving by the transmission device, sending a loading frame loaded with the magnet blocks orderly through a preparation chamber, a pre-heating and degreasing chamber, a first degassing chamber, a second degassing chamber, a pre-sintering chamber, a sintering chamber, an aging treatment chamber and a cooling chamber of the continuous vacuum sintering furnace, respectively for removing organic impurities via pre-heating, heating to dehydrogenate and degas, pre-sintering, sintering, aging and cooling; after cooling, extracting the magnet block out of the continuous vacuum sintering furnace and then sending the magnet block into a vacuum aging treatment furnace for a second aging treatment, wherein the second aging treatment is executed at a temperature of 450-650° C.; rapidly quenching after the second aging treatment, and obtaining the sintered NdFeB rare earth permanent magnet; and then, processing the sintered NdFeB rare earth permanent magnet into a NdFeB rare earth permanent magnetic device through machining and a surface treatment.

Preferably, the loading frame enters a loading chamber before entering the preparation chamber of the continuous vacuum sintering furnace; in the loading chamber, the magnet block after the isostatic pressing are unpacked and loaded into the charging box; then, the charging box is loaded onto the loading frame which is sent into the preparation chamber through a valve while driven by the transmission device.

The step of pre-sintering comprises steps of: providing a continuous vacuum pre-sintering furnace for pre-sintering; loading the charging box which is filled with the compacted magnet blocks onto a sintering loading frame; while driving by the transmission device, sending the sintering loading frame orderly through a preparation chamber, a degreasing chamber, a first degassing chamber, a second degassing chamber, a third degassing chamber, a first pre-sintering chamber, a second pre-sintering chamber and a cooling chamber of the continuous vacuum pre-sintering furnace, respectively for pre-heating to degrease, heating to dehydrogenate and degas, pre-sintering and cooling, wherein argon is provided for cooling; and after cooling, extracting the sintering loading frame out of the continuous vacuum pre-sintering furnace, and then loading the charging box onto an aging loading frame. The step of sintering comprises steps of: hanging up the aging loading frame, and sending the aging loading frame orderly through a pre-heating chamber, a heating chamber, a sintering chamber, a high-temperature aging chamber, a pre-cooling chamber, a low-temperature aging chamber and a cooling chamber of a continuous vacuum sintering aging furnace, respectively for sintering, aging at a high temperature, pre-cooling, aging at a low temperature and rapidly air-cooling.

In some embodiments, the sintering loading frame is processed with pre-heating to degrease at a temperature of 200-400° C., heating to dehydrogenate and degas at a temperature of 400-900° C., pre-sintering at a temperature of 900-1050° C., sintering at a temperature of 1010-1085° C., aging at the high temperature of 800-950° C., and then aging at the low temperature of 450-650° C.; and, after a thermal preservation, the sintering loading frame is sent into the cooling chamber to be rapidly cooled with argon or nitrogen.

In some embodiments, the sintering loading frame is processed with pre-heating to degrease at a temperature of 200-400° C., heating to dehydrogenate and degas at a temperature of 550-850° C., pre-sintering at a temperature of 960-1025° C., sintering at a temperature of 1030-1070° C., aging at the high temperature of 860-940° C., and then aging at the low temperature of 460-640° C.; and, after a thermal preservation, the sintering loading frame is sent into the cooling chamber to be rapidly cooled with argon or nitrogen.

In some embodiments, the step of pre-sintering comprises pre-sintering in a vacuum degree higher than $5\times10^{-1}$ Pa; and the step of sintering comprises sintering in a vacuum degree between $5\times10^{-1}$ Pa and $5\times10^{-3}$ Pa.

In some embodiments, the step of pre-sintering comprises pre-sintering in a vacuum degree higher than 5 Pa; and the step of sintering comprises sintering in a vacuum degree between 500 Pa and 5000 Pa, and filling in argon during sintering.

The sintering loading frame has an effective width of 400-800 mm; and the aging loading frame has an effective width of 300-400 mm.

The step of pre-sintering generates the magnet having a density of 7.2-7.5 g/cm$^3$; and the step of sintering generates the magnet having a density of 7.5-7.7 g/cm$^3$.

The NdFeB permanent magnet comprises a main phase and a grain boundary phase. The main phase has a structure of $R_2(Fe,Co)_{14}B$, wherein a heavy rare earth HR content of a range, extending inwardly by one third from an outer edge of the main phase, is higher than the heavy rare earth HR content at a center of the main phase; the grain boundary phase has micro particles of $Nd_2O_3$; R comprises at least one rare earth element, Nd; and HR comprises at least one member selected from a group consisting of Dy, Tb, Ho and Y.

In some embodiments, the NdFeB permanent magnet has a metal phase structure that a $ZR_2(Fe_{1-x}Co_x)_{14}B$ phase, having a higher heavy rare earth content than a $R_2(Fe_{1-x}Co_x)_{14}$ B phase, surrounds around $R_2(Fe_{1-x}Co_x)_{14}B$ grains; no grain boundary phase exists between the $ZR_2(Fe_{1-x}Co_x)_{14}$ B phase and the $R_2(Fe_{1-x}Co_x)_{14}B$ phase; and the $ZR_2(Fe_{1-x}Co_x)_{14}B$ phase is connected through the grain boundary phase, wherein ZR represents the rare earth of the phase, having a heavy rare earth content in a grain phase higher than a content of the heavy rare earth in an averaged rare earth content; $0 \leq x \leq 0.5$.

In some embodiments, the micro particles of $Nd_2O_3$ are provided in the grain boundary phase at boundaries of at least two grains of the $ZR_2(Fe_{1-x}Co_x)_{14}B$ phase of the metal phase structure of the NdFeB permanent magnet.

In some embodiments, the micro particles of $T_2O_3$ and $Nd_2O_3$ are provided in the grain boundary phase at boundaries of at least two grains of the $ZR_2(Fe_{1-x}Co_x)_{14}B$ phase of the metal phase structure of the NdFeB permanent magnet.

The grains of the NdFeB permanent magnet, prepared through the preparation method of the sintered NdFeB rare earth permanent magnet, have a size of 3-25 μm, preferably 5-15 μm.

A rich B phase begins to melt gradually at a temperature higher than 500° C. during sintering; and, at a temperature higher than 800° C., a kinetic energy of melting increases and the magnet block gradually alloys. According to the present invention, while the magnet alloy is alloying, the magnet block undergoes a rare earth diffusion and displacement reaction, wherein the HR elements surrounding around the $R_2(Fe_{1-x}Co_x)_{14}B$ phase and the HR elements in the $T_2O_3$ micro powder gradually displace with Nd surrounding around the $R_2(Fe_{1-x}Co_x)_{14}B$ phase. When the reaction lasts longer, more and more Nd are displaced with the HR elements and a $ZR_2(Fe_{1-x}Co_x)_{14}B$ phase having a relatively higher content of the HR elements is formed; and, the $ZR_2(Fe_{1-x}Co_x)_{14}B$ phase surrounds around a periphery of the $R_2(Fe_{1-x}Co_x)_{14}B$ phase and a structural main phase, having the $ZR_2(Fe_{1-x}Co_x)_{14}B$ phase surrounding around the $R_2(Fe_{1-x}Co_x)_{14}B$ phase, is formed. After entering the grain boundary, the Nd is firstly combined with 0 to form micro particles of $Nd_2O_3$, which effectively restrain a $R_2Fe_{14}B$ phase from growing up; especially, the micro particles of $Nd_2O_3$ at the boundaries of at least two grains, effectively restrain the grains from fusion and restrict the grains to grow up abnormally, and greatly improve a coercive force of the permanent magnet. According to the present invention, the micro particles of $Nd_2O_3$ are provided at the boundaries of at least two grains; and elements of the grain boundary phase comprise Nd, Co, Al, Ga and O.

These and other objectives, features, and advantages of the present invention will become apparent from the following detailed description, the accompanying drawings, and the appended claims.

Figure 1:
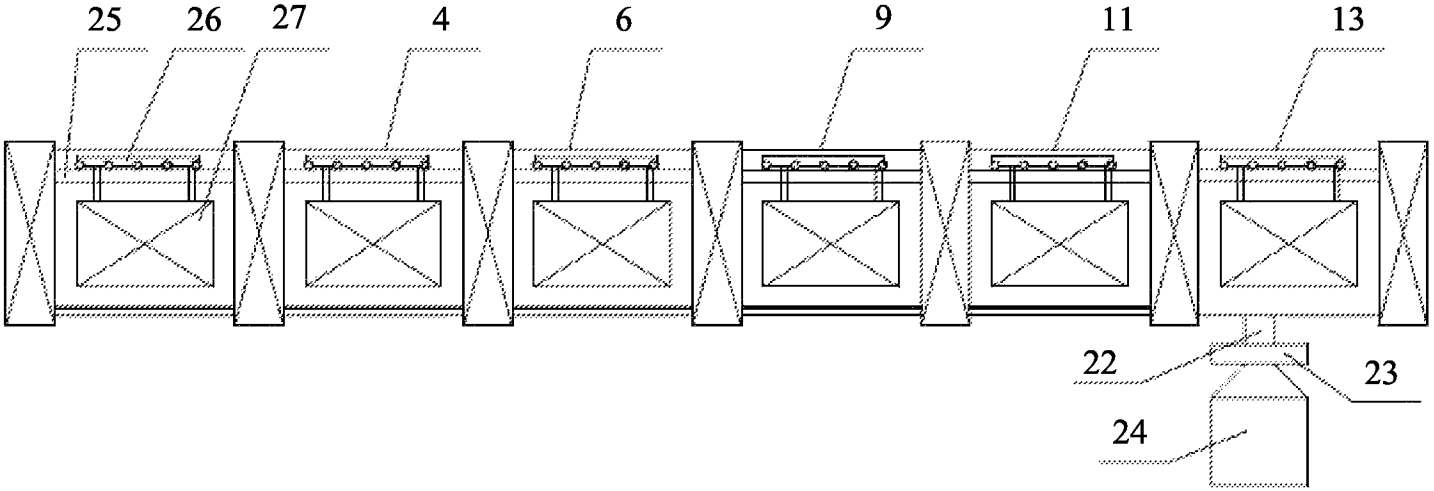
FIG. 1 is a front view of a continuous hydrogen pulverization equipment for NdFeB rare earth permanent magnetic alloy according to preferred embodiments of the present invention.
Figure 2:
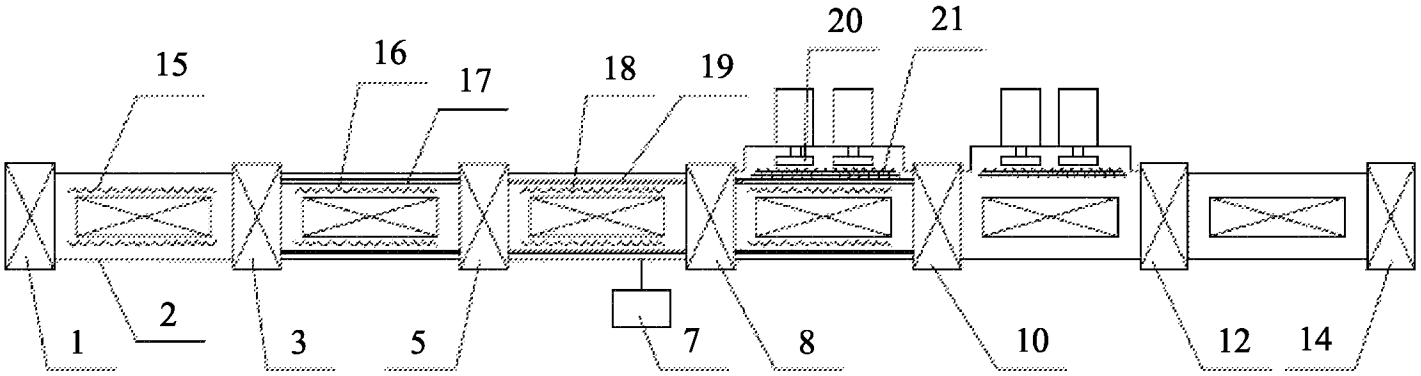
FIG. 2 is a top view of the continuous hydrogen pulverization equipment according to the preferred embodiments of the present invention.

In the figures, 1: feeding valve; 2: hydrogen absorption chamber; 3: hydrogen absorption valve; 4: first heating and dehydrogenating chamber; 5: first chamber isolating valve; 6: second heating and dehydrogenating chamber; 7: quantitative hydrogen filling device; 8: second chamber isolating valve; 9: first cooling chamber; 10: third chamber isolating valve; 11: second cooling chamber; 12: discharging valve; 13: discharging chamber; 14: discharging door of the discharging chamber; 15: first heater; 16: second heater; 17: first heat preservation screen; 18: third heater; 19: second heat preservation screen; 20: cooling fan; 21: heat exchanger; 22: connecting pipe; 23: valve; 24: storage tank; 25: guide rail; 26: transport cart; 27: charging box.

As showed in the figures, the feeding valve 1 is connected with a feeding port of the hydrogen absorption chamber 2; a discharging port of the hydrogen absorption chamber 2 is connected with the hydrogen absorption valve 3; the hydrogen absorption valve 3 is connected with a feeding port of the first heating and dehydrogenating chamber 4; a discharging port of the first heating and dehydrogenating chamber 4 is connected with the first chamber isolating valve 5; the first chamber isolating valve 5 is connected with a feeding port of the second heating and dehydrogenating chamber 6; a discharging port of the second heating and dehydrogenating chamber 6 is connected with the second chamber isolating valve 8; the second isolating valve 8 is connected with a feeding port of the first cooling chamber 9; a discharging port of the first cooling chamber 9 is connected with the third chamber isolating valve 10; the third chamber isolating valve 10 is connected with a feeding port of the second cooling chamber 11; a discharging port of the second cooling chamber 11 is connected with the discharging valve 12; the discharging valve 12 is connected with a feeding port of the discharging chamber 13; a final port of the discharging chamber 13 is connected with the discharging door 14 of the discharging chamber; the first heater 15 is provided in the hydrogen absorption chamber 2; the second heater 16 is provided in the first heating and dehydrogenating chamber 4; the first heat preservation screen 17 is provided outside the second heater 16; the third heater 18 is provided in the second heating and dehydrogenating chamber 6; the second heat preservation screen 19 is provided outside the third heater 18; the second heating and dehydrogenating chamber 6 is further connected with the quantitative hydrogen filling device 7; the cooling fan 20 and the heat exchanger 21 are provided in the first cooling chamber 9; the connecting pipe 22 is provided at a lower part of the discharging chamber 13; the connecting pipe 22 is connected with the storage tank 24 through the valve 23; the guide rail 25 is provided at an upper part of the hydrogen absorption chamber 2, the first heating and dehydrogenating chamber 4, the second heating and dehydrogenating chamber 6, the first cooling chamber 9 and the discharging chamber 13; the transport cart 26 with rolling wheels is provided on the guide rail 25; the charging box 27, hanging below the transport cart 26, successively passes through the chambers; and an evacuating machine set and a gas filling system are arranged in each of the hydrogen absorption chamber 2, the first heating and dehydrogenating chamber 4, the second heating and dehydrogenating chamber 6, the first cooling chamber 9 and the discharging chamber 13.

DETAILED DESCRIPTION OF THE PREFERRED EMBODIMENT

The present invention is further illustrated through following embodiments.

First Embodiment

Figure 3:
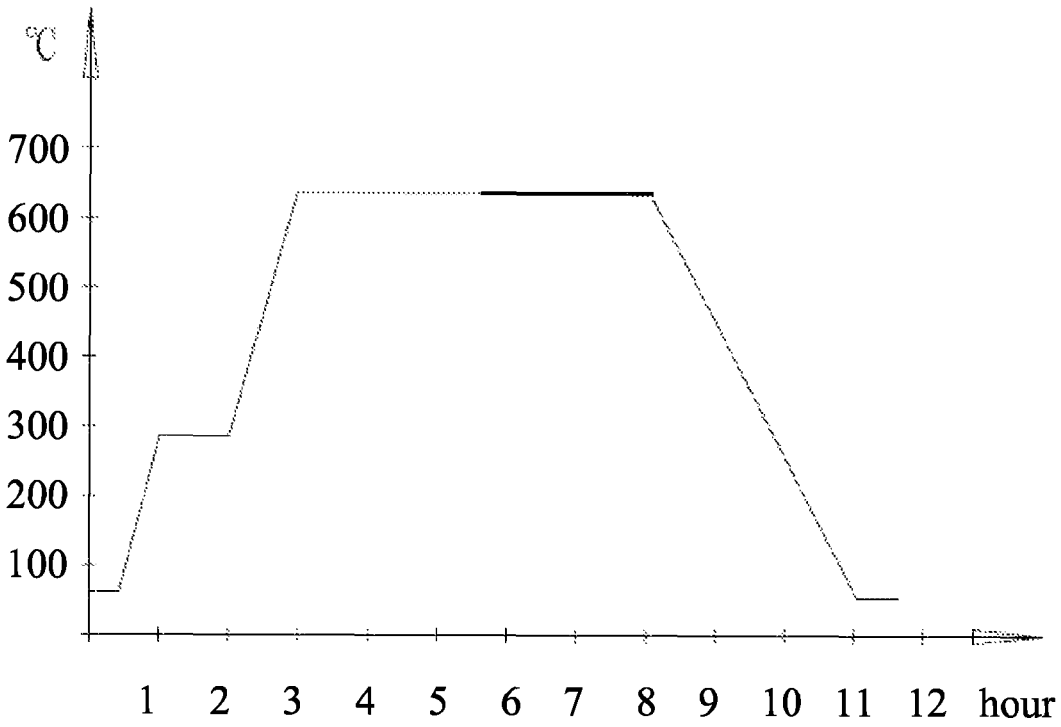
FIG. 3 is a process curve of a hydrogen pulverization according to the preferred embodiments of the present invention.

Alloy raw materials having a magnetic component of $Nd_{30}Dy_1Co_{1.2}Cu_{0.1}B_{0.9}Al_{0.1}Fe_{rest}$ and $Dy_2O_3$ micro powder were heated up over 500° C. in vacuum. Argon was filled, and R—Fe—B-M raw materials were further heated to melt and refine into a smelt alloy liquid. Thereafter, the smelt alloy liquid was casted into a rotating roller with water quenching through an intermediate tundish, so as to obtain alloy flakes. A continuous vacuum hydrogen pulverization furnace was provided for a hydrogen pulverization, wherein the alloy flakes were firstly loaded into a hanging charging box; and then the charging box was orderly sent into a hydrogen absorption chamber, a heating and dehydrogenating chamber and a cooling chamber of the continuous vacuum hydrogen pulverization furnace, respectively for absorbing hydrogen, heating to dehydrogenate and cooling. Then, in a protective atmosphere, the alloy flakes after the hydrogen pulverization were loaded into a storage tank. A process curve of the hydrogen pulverization is showed as FIG. 3, wherein: the charging box, loading with the alloy flakes, was firstly sent into the hydrogen absorption chamber; hydrogen was filled after evacuating the hydrogen absorption chamber to $5\times10^{-1}$ Pa; then the hydrogen absorption chamber was heated, and a hydrogen filling speed and heating power were adjusted for maintaining the hydrogen absorption chamber at a temperature of 260-290° C. for 2 hours for absorbing the hydrogen; thereafter, the charging box was sent into the heating and dehydrogenating chamber for dehydrogenating at a temperature of 660-690° C. for 6 hours, wherein at ten minutes before the dehydrogenating was over, an evacuating valve was closed to stop evacuating and a certain amount of the hydrogen was filled; then the charging box was sent into the cooling chamber, argon was filled and a cooling fan was initiated for cooling the charging box for 6 hours. The alloy flakes, after the hydrogen pulverization, were mixed and then powdered by a jet mill. Powder was mixed by a mixing device under a protection of nitrogen, and then sent to be compacted into a magnet block by a sealed magnetic field compressor of the present invention. A protective box having an oxygen content of 150 ppm, an alignment magnetic field intensity of 1.8 T, and a mold chamber inner temperature of 3° C. was provided. The magnet block had a size of 62 mm×52 mm×42 mm, and was aligned at a direction of the 42 mm; and after compacting, the magnet block was sealed in the protective box. The magnet block was extracted out of the protective box for isostatic pressing at an isostatic pressure of 200 MPa. Then, under the protection of the nitrogen, the magnet block was sent into a continuous vacuum sintering furnace for sintering; while driving by a transmission device, a loading frame loaded with the magnet block was orderly sent into a preparation chamber, a pre-heating and degreasing chamber, a first degassing chamber, a second degassing chamber, a pre-sintering chamber, a sintering chamber, an aging treatment chamber and a cooling chamber of the continuous vacuum sintering furnace, respectively for removing organic impurities via pre-heating, heating to dehydrogenate and degas, pre-sintering, sintering, aging and cooling; after cooling, the magnet block was extracted out of the continuous vacuum sintering furnace and then sent into a vacuum aging treatment furnace for a second aging treatment, wherein the second aging treatment is executed at a temperature of 450-650° C.; after the second aging treatment, the magnet block was rapidly quenched, and sintered NdFeB rare earth permanent magnet was obtained; and then, the sintered NdFeB rare earth permanent magnet was processed into a NdFeB rare earth permanent magnetic device through machining and a surface treatment. As showed in Table 1, absorbing the hydrogen at a temperature of 260-290° C. and dehydrogenating at a temperature of 660-690° C. greatly increase performance of the magnet.

First Comparison

Alloy raw materials having a magnetic component of $Nd_{30}Dy_1Co_{1.2}Cu_{0.1}B_{0.9}Al_{0.1}Fe_{rest}$, the same as the alloy raw materials of the first embodiment, were conventionally smelted into alloy flakes. Then the alloy flakes were conventionally processed with a hydrogen pulverization, powdering by a jet mill, compacting in a magnetic field, sintering and an aging treatment to form a magnet. Performance of the magnet is also showed in Table 1. By comparing, benefits of the present invention are showed.

TABLE 1

Influences of temperature of absorbing hydrogen and temperature of dehydrogenating on performance of magnet

| Order | T. of absorbing hydrogen (° C.) | T. of dehydrogenating (° C.) | Magnetic energy product (MGOe) | Coercive force (KOe) | Magnetic energy product (MGOe) + coercive force (KOe) | Weightlessness (g/cm$^2$) |
|---|---|---|---|---|---|---|
| 1 | 260 | 660 | 48.3 | 19.2 | 67.5 | 3.3 |
| 2 | 260 | 670 | 49.5 | 20.3 | 69.8 | 3.5 |
| 3 | 260 | 680 | 49.2 | 20.6 | 69.8 | 2.3 |
| 4 | 260 | 690 | 48.4 | 20.1 | 68.5 | 2.1 |
| 5 | 270 | 690 | 48.1 | 20.6 | 68.7 | 2.6 |
| 6 | 270 | 685 | 48.8 | 21.4 | 70.2 | 3.5 |
| 7 | 280 | 680 | 49.8 | 21.8 | 71.6 | 3.3 |
| 8 | 280 | 675 | 49.5 | 22.4 | 72.9 | 3.2 |
| 9 | 290 | 670 | 48.9 | 21.6 | 71.5 | 3.5 |
| 10 | 290 | 665 | 48.6 | 21.1 | 69.7 | 3.3 |
| First comparison | 0 | 0 | 47.6 | 17.5 | 65.1 | 6.8 |

Second Embodiment

Alloy raw materials having a magnetic component of $(Pr_{0.2}Nd_{0.8})_{22.5}Dy_{2.5}Co_{1.2}Cu_{0.3}B_{0.9}Al_{0.2}Fe_{rest}$ were heated up over 500° C. in vacuum. Argon was filled and R—Fe—B-M raw materials ware further heated to melt and refine into a smelt alloy liquid, wherein $T_2O_3$ micro powder was added. Thereafter, the smelt alloy liquid was casted into a rotating roller with water quenching through an intermediate tundish, so as to obtain alloy flakes. A continuous vacuum hydrogen pulverization furnace was provided for a hydrogen pulverization, wherein the alloy flakes were firstly loaded into a hanging charging box; and then the charging box was orderly sent into a hydrogen absorption chamber, a heating and dehydrogenating chamber and a cooling chamber of the continuous vacuum hydrogen pulverization furnace, respectively for absorbing hydrogen, heating to dehydrogenate and cooling. Then, in a protective atmosphere, the alloy flakes after the hydrogen pulverization were loaded into a storage tank. The charging box, loading with the alloy flakes, was firstly sent into the hydrogen absorption chamber; hydrogen was filled after evacuating the hydrogen absorption chamber to 5 Pa; then the hydrogen absorption chamber was heated, and a hydrogen filling speed and heating power were adjusted for maintaining the hydrogen absorption chamber at a temperature of 210-240° C. for 4 hours for absorbing the hydrogen; thereafter, the charging box was sent into the heating and dehydrogenating chamber for dehydrogenating at a temperature of 660-690° C. for 8 hours, wherein at ten minutes before the dehydrogenating was over, an evacuating valve was closed to stop evacuating and a certain amount of the hydrogen was filled; then the charging box was sent into the cooling chamber, argon was filled and a cooling fan was initiated for cooling the charging box for 8 hours. The alloy flakes, after the hydrogen pulverization, were mixed and then powdered by a jet mill under a protection of nitrogen. Powder was mixed by a mixing device under the protection of the nitrogen, and then sent to be compacted into a magnet block by automatically compacting in a magnetic field, as described in the present invention. The magnet block had a size of 62 mm×52 mm×42 mm, and was aligned at a direction of the 42 mm. After compacting, the magnet block was sent into a continuous vacuum pre-sintering furnace for pre-sintering; after the pre-sintering, the magnet block was sent into a continuous vacuum sintering aging furnace for sintering, aging at a high temperature, pre-cooling and aging at a low temperature. Influences of oxide micro powder and adding the certain amount of the hydrogen are showed in Table 2. As showed in the Table 2, adding $Tb_2O_3$, $Dy_2O_3$, $Al_2O_3$ and $Y_2O_3$ and filling the certain amount of hydrogen are able to greatly increase performance of the magnet.

Second Comparison

Alloy raw materials having a magnetic component of $Nd_{30}Dy_1Co_{1.2}Cu_{0.1}B_{0.9}Al_{0.1}Fe_{rest}$, the same as the alloy raw materials of the first embodiment, were conventionally smelted into alloy flakes. Then the alloy flakes were conventionally processed with a hydrogen pulverization, powdering by a jet mill, compacting in a magnetic field, sintering and an aging treatment to form a magnet. Performance of the magnet is showed in Table 2. By comparing, benefits of the present invention are showed.

TABLE 2

Influences of oxide micro powder and adding certain amount of hydrogen on performance of magnet

| Order | Oxide micro powder | Adding a certain amount of hydrogen or not | Magnetic energy product (MGOe) | Coercive force (KOe) | Magnetic energy product (MGOe) + coercive force (KOe) | Weightlessness (g/cm$^2$) |
|---|---|---|---|---|---|---|
| 1 | $Al_2O_3$ | Yes | 41.1 | 27.2 | 68.3 | 3.4 |
| 2 | $Al_2O_3$ | No | 40.5 | 27.8 | 68.3 | 3.8 |
| 3 | $Dy_2O_3$ | Yes | 41.8 | 28.4 | 70.2 | 3.6 |
| 4 | $Dy_2O_3$ | No | 40.4 | 28.6 | 69.0 | 3.8 |
| 5 | $Tb_2O_3$ | Yes | 41.5 | 28.1 | 69.6 | 4.3 |
| 6 | $Tb_2O_3$ | No | 40.3 | 27.4 | 67.7 | 4.5 |
| 7 | $Y_2O_3$ | Yes | 41.7 | 29.2 | 70.9 | 4.3 |

TABLE 2-continued

Influences of oxide micro powder and adding certain amount of hydrogen on performance of magnet

| Order | Oxide micro powder | Adding a certain amount of hydrogen or not | Magnetic energy product (MGOe) | Coercive force (KOe) | Magnetic energy product (MGOe) + coercive force (KOe) | Weightlessness (g/cm$^2$) |
|---|---|---|---|---|---|---|
| 8 | $Y_2O_3$ | No | 40.9 | 28.5 | 69.4 | 4.1 |
| Second comparison | 0 | 0 | 39.1 | 24.6 | 63.7 | 6.2 |

By comparing the embodiments with the comparisons, the method and the equipment provided by the present invention greatly improve performance of the NdFeB permanent magnet and own a broad development prospect.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A method for processing NdFeB rare earth permanent magnetic alloy with a hydrogen pulverization, comprising steps of:

providing a continuous hydrogen pulverization equipment for hydrogen pulverizing rare earth permanent magnetic alloy;

loading rare earth permanent magnetic alloy flakes into a charging box;

subjecting the rare earth permanent magnetic alloy flakes to hydrogen pulverization by passing the charging box which is driven by a transmission device orderly through a hydrogen absorption chamber, a heating and dehydrogenating chamber and a cooling chamber of the continuous hydrogen pulverization equipment, wherein a quantitative hydrogen filling device is provided in the heating and dehydrogenating chamber and a certain amount of the hydrogen is filled in before dehydrogenating is over;

receiving the charging box by a discharging chamber through a discharging valve;

pouring out the alloy flakes after the hydrogen pulverization into a storage tank at a lower part of the discharging chamber;

sealing up the storage tank under a protection of nitrogen; and moving the charging box out through a discharging door of the discharging chamber and re-loading the charging box for repeating the previous steps; wherein:

the hydrogen absorption chamber has a temperature controlled at between 50° C. and 350° C. for absorbing hydrogen; and the continuous hydrogen pulverization equipment comprises at least one heating and dehydrogenating chamber, having a temperature controlled at between 600° C. and 900° C. for dehydrogenating, and at least one cooling chamber.

2. The method for processing the NdFeB rare earth permanent magnetic alloy with the hydrogen pulverization, as recited in claim 1, wherein:

the continuous hydrogen pulverization equipment comprises two heating and dehydrogenating chambers, wherein the charging box stays in the two heating and dehydrogenating chambers successively while staying in each heating and dehydrogenating chamber for between 2 hours and 6 hours;

and the continuous hydrogen pulverization equipment comprises two cooling chambers, wherein the charging box stays in the two cooling chambers successively while staying in each cooling chamber for between 2 hours and 6 hours.

3. The method for processing the NdFeB rare earth permanent magnetic alloy with the hydrogen pulverization, as recited in claim 1, wherein:

the continuous hydrogen pulverization equipment comprises three heating and dehydrogenating chambers, wherein the charging box stays in the three heating and dehydrogenating chambers successively while staying in each heating and dehydrogenating chamber for between 1 hour and 4 hours;

and the continuous hydrogen pulverization equipment comprises three cooling chambers, wherein the charging box stays in the three cooling chambers successively while staying in each cooling chamber for between 1 hour and 4 hours.

4. The method for processing the NdFeB rare earth permanent magnetic alloy with the hydrogen pulverization, as recited in claim 1, wherein a heater is provided in the hydrogen absorption chamber and the hydrogen absorption chamber has a temperature controlled at a range of 80-300° C. for heating.

5. A method for preparing a NdFeB rare earth permanent magnet, comprising steps of:

casting rare earth permanent magnetic alloy into alloy flakes;

hydrogen pulverizing the alloy flakes a continuous hydrogen pulverization equipment, comprising steps of: loading the alloy flakes into a charging box; passing the charging box which is driven by a transmission device orderly through a feeding valve, a hydrogen absorption chamber, a hydrogen absorption valve, a heating and dehydrogenating chamber, chamber isolating valves and a cooling chamber of the continuous hydrogen pulverization equipment; receiving the charging box by a discharging chamber through a discharging valve; pouring out the alloy flakes after the hydrogen pulverization into a storage tank at a lower part of the discharging chamber; sealing up the storage tank under a protection of nitrogen; and moving the charging box out through a discharging door of the discharging chamber and re-loading the charging box, for repeating the previous steps, wherein a quantitative hydrogen filling device is provided in the heating and dehydrogenating chamber and a certain amount of the hydrogen is filled in before dehydrogenating is over;

sending the storage tank into a mixing device for pre-mixing;

after the pre-mixing, powdering the alloy flakes into alloy powder by a jet mill under the protection of nitrogen;

then obtaining a rare earth permanent magnet via compacting in a magnetic field and sintering; and finally processing the rare earth permanent magnet by machining and a surface treatment.

6. The method for preparing the NdFeB rare earth permanent magnet, as recited in claim 5, further comprising a step of adding a lubricant or an antioxidant into the storage tank, before the step of sending the storage tank into the mixing device for pre-mixing.

7. The method for preparing the NdFeB rare earth permanent magnet, as recited in claim 5, further comprising a step of adding $T_2O_3$ micro powder into the storage tank, before the step of sending the storage tank into the mixing device for pre-mixing, wherein $T_2O_3$ is at least one member selected from the group consisting of $Dy_2O_3$, $Tb_2O_3$, $Ho_2O_3$, $Y_2O_3$, $Al_2O_3$ and $Ti_2O_3$.

8. The method for preparing the NdFeB rare earth permanent magnet, as recited in claim 5, further comprising a step of mixing the alloy powder, after the step of powdering the alloy flakes into the alloy powder by the jet mill under the protection of nitrogen and before the step of compacting in the magnetic field.

9. The method for preparing the NdFeB rare earth permanent magnet, as recited in claim 5, wherein the step of obtaining the NdFeB rare earth permanent magnet via compacting in the magnetic field and sintering comprises steps of: compacting by a sealed magnetic field compressor under the protection of nitrogen and obtaining a magnet block; packaging the magnet block and extracting the magnet block out of the sealed magnetic field compressor under the protection of nitrogen; processing the magnet block with isostatic pressing and then sintering.

10. The method for preparing the NdFeB rare earth permanent magnet, as recited in claim 5, wherein the NdFeB permanent magnet comprises a main phase and a grain boundary phase; the main phase has a structure of $R_2(Fe, Co)_{14}B$, wherein a heavy rare earth HR content between the edge of a main phase grain to a location which is ⅓ of the distance from the edge to the center of the main phase gain is higher than a heavy rare earth HR content at the center of the main phase grain; the grain boundary phase has micro particles of $Nd_2O_3$; R comprises at least Nd; and HR is at least one member selected from the group consisting of Dy, Tb, Ho and Y.

11. The method for preparing the NdFeB rare earth permanent magnet, as recited in claim 5, wherein the NdFeB permanent magnet has a metal phase structure comprising a $ZR_2(Fe_{1-x}Co_x)_{14}B$ phase and a $R_2(Fe_{1-x}Co_x)_{14}B$ phase, the $ZR_2(Fe_{1-x}Co_x)_{14}B$ phase surrounds the $R_2(Fe_{1-x}Co_x)_{14}B$ phase and has a higher heavy rare earth content that the $R_2(Fe_{1-x}Co_x)_{14}B$ phase, no grain boundary phase exists between $ZR_2(Fe_{1-x}Co_x)_{14}B$ phase and the $R_2(Fe_{1-x}Co_x)_{14}B$ phase; wherein ZR represents total rare earth elements of the $ZR_2(Fe_{1-x}Co_x)_{14}B$ phase and the heavy rare earth content in the $ZR_2(Fe_{1-x}Co_x)_{14}B$ phase is higher than an average content of heavy rare earth elements in the NdFeB rare earth permanent magnet; $0 \leq x \leq 0.5$.

12. The method for preparing the NdFeB rare earth permanent magnet, as recited in claim 5, wherein micro particles of $Nd_2O_3$ are provided in a grain boundary phase at boundaries of at least two grains of a $ZR_2(Fe_{1-x}Co_x)_{14}B$ phase of a metal phase structure of the NdFeB permanent magnet.

13. The method for preparing the NdFeB rare earth permanent magnet, as recited in claim 5, wherein micro particles of $T_2O_3$ and $Nd_2O_3$ are provided in a grain boundary phase at boundaries of at least two grains of a $ZR_2(Fe_{1-x}Co_x)_{14}B$ phase of a metal phase structure of the NdFeB permanent magnet.

* * * * *